US006575557B2

(12) United States Patent
Tominaga

(10) Patent No.: US 6,575,557 B2
(45) Date of Patent: Jun. 10, 2003

(54) RECORDING UNIT AND INK JET TYPE RECORDING APPARATUS EQUIPPED WITH THE RECORDING UNIT

(75) Inventor: Kazuyoshi Tominaga, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/938,379

(22) Filed: Aug. 24, 2001

(65) Prior Publication Data

US 2002/0024554 A1 Feb. 28, 2002

(30) Foreign Application Priority Data

Aug. 31, 2000 (JP) ..... 2000-263836

(51) Int. Cl.[7] ..... B41J 25/304
(52) U.S. Cl. ..... 347/37; 347/8
(58) Field of Search ..... 347/37, 19, 49, 347/8

(56) References Cited

U.S. PATENT DOCUMENTS 4,544,931 A * 10/1985 Watanabe et al. ..... 347/37
5,138,590 A 8/1992 Masuda et al. ..... 368/10
5,250,956 A * 10/1993 Haselby et al. ..... 347/19
5,359,355 A * 10/1994 Nagoshi et al. ..... 347/37
5,608,433 A * 3/1997 Quate ..... 347/37
5,771,050 A * 6/1998 Gielen ..... 347/37
5,956,054 A * 9/1999 Hirabayashi et al. ..... 347/37
6,092,887 A * 7/2000 Tanino et al. ..... 347/37
6,164,746 A * 12/2000 Akahira et al. ..... 347/15

FOREIGN PATENT DOCUMENTS

EP 000031421 A2 * 7/1981 ..... 347/37
JP 357074168 * 5/1982 ..... 347/37

* cited by examiner

*Primary Examiner*—Huan Tran
*Assistant Examiner*—Julian D. Huffman
(74) *Attorney, Agent, or Firm*—Adams & Wilks

(57) ABSTRACT

A recording unit has a carriage for undergoing movement in a main scanning direction and slide members mounted on the carriage for undergoing sliding movement relative to the carriage in a sub-scanning direction extending generally perpendicular to the main scanning direction. Ink jet heads are mounted on the carriage and have nozzle openings for ejecting ink, a first end portion mounted on the carriage for undergoing rotation relative to the carriage and undergoing movement relative to the carriage in the sub-scanning direction but restricted from undergoing movement relative to the carriage in the main scanning direction, and a second end portion connected to a respective one of the slide members for undergoing sliding movement relative to the carriage in the sub-scanning direction.

18 Claims, 8 Drawing Sheets

RECORDING UNIT AND INK JET TYPE RECORDING APPARATUS EQUIPPED WITH THE RECORDING UNIT

BACKGROUND OF THE INVENTION

1. Field of the Invention

The present invention relates to a recording unit having an ink jet head and applicable, for example, to a printer and a facsimile apparatus, and to an ink jet type recording apparatus using the same. In particular, the present invention relates to an ink jet head position adjusting mechanism.

2. Description of the Related Art

Conventionally, an ink jet type recording apparatus has been known which records characters and images on recording mediums by using an ink jet head ejecting ink from a plurality of nozzles. In this ink jet type recording apparatus, while moving a carriage on which the ink jet head is mounted in the main scanning direction with respect to the recording medium, ink is ejected from the nozzles of the ink jet head to print a dot pattern in a predetermined region. After the completion of one main scanning, the recording medium is moved in the sub scanning direction by a predetermined amount. By repeating these operations, printing is performed in the entire desired region.

In a large ink jet recording apparatus, a plurality of ink jet heads corresponding to inks of different colors are mounted on the carriage. In such a large ink jet recording apparatus, it is necessary to fasten the ink jet heads to the carriage while effecting positioning such that the nozzle interval in each ink jet head is adjusted with a relatively high level of accuracy to be within an error range, for example, of approximately ±35 $\mu$m. When the positional accuracy of each ink jet type recording head is rather low, a printing deficiency, such as unevenness in density, occurs.

In view of this, in the conventional ink jet type recording apparatus, printing is executed, with the ink jet heads being temporarily installed, and in accordance with the positional deviation amount measured from the printing result, each ink jet head is moved through eye measurement. By repeatedly executing this operation, the position of each ink jet head is adjusted so as to be within a predetermined error range.

Here, generally speaking, the positional adjustment of an ink jet head consists of two adjustments: the adjustment of positional deviation in the sub scanning direction, and the adjustment of the angle with respect to the sub scanning direction. When, for example, the adjustment of positional deviation in the sub scanning direction is first conducted, and then the adjustment of the angle with respect to the sub scanning direction is conducted, the position in the sub scanning direction is deviated again. If the order of adjustment is altered, a similar angular deviation occurs, which means a fine positional adjustment of the ink jet head is difficult to perform.

To make this positional adjustment of the ink jet head relatively easy, a technique has been proposed according to which a wedge-like member, for example, is forced between the ink jet head and the carriage to thereby effect a fine positional adjustment.

According to another technique that has been proposed, a predetermined pattern is printed, and a positional deviation amount is automatically recognized from this printed pattern, the position of each ink jet head being automatically adjusted by a motor or the like.

In the former technique, however, while it is possible to move the ink jet head by a minute amount by forcing in the wedge-like member, it is rather difficult to accurately ascertain the movement amount. Further, once the ink jet head has been moved, it is difficult to restore it to the former position, with the result that the positional adjustment takes a lot of time.

In the latter case, positional adjustment can be conducted easily and reliably since the position of the ink jet head is automatically adjusted. However, this technique involves a complicated structure, resulting in a considerably high cost.

SUMMARY OF THE INVENTION

In view of the above problems, it is an object of the present invention to provide a recording unit and an ink jet recording apparatus in which it is possible to perform the head position adjustment easily and reliably with a relatively simple structure.

To solve the above-mentioned problem, according to a first aspect of the present invention, there is provided a recording unit comprising a plurality of ink jet heads having a plurality of nozzle openings for ejecting ink, and a carriage on which the plurality of ink jet heads are mounted, characterized in that: one end portions of the ink jet heads with respect to a sub scanning direction perpendicular to the scanning direction of the carriage are supported so as to be restricted in the movement of the scanning direction of the carriage with respect to the carriage and so as to be movable in the sub scanning direction and rotatable; and the other end portions of the ink jet heads are positioned and fastened to a slide member provided so as to allow positioning and movement in the sub scanning direction with respect to the carriage.

According to a second aspect of the present invention, in the first aspect of the invention, the recording unit is characterized in that the slide member is connected to the carriage by a screw member having a length covering at least the slide member and the carriage and adapted to be threadedly engaged with an associated female screw hole through a through-hole in one of the slide member and the carriage, and can be positioned and moved in the sub scanning direction by adjusting the amount by which the screw member is engaged with the female screw hole.

According to a third aspect of the present invention, in the first aspect of the invention, the recording unit is characterized in that: an engagement member fastened to the other end portions of the ink jet heads with respect to the sub scanning direction and the slide member are connected by a rotatably held eccentric pin, whereby the ink jet heads are positioned and fixed with respect to the carriage; and by rotating the eccentric pin, the other end portions of the ink jet heads can be moved in the scanning direction.

According to a fourth aspect of the present invention, in the second aspect of the invention, the recording unit is characterized by comprising a biasing member for biasing the ink jet heads in the sub scanning direction to fix them at positioning positions in correspondence with the amount by which the screw member is threadedly engaged.

According to a fifth aspect of the present invention, in the fourth aspect of the invention, the recording unit is characterized in that the biasing member is a spring member provided in the outer periphery of the screw member between the carriage and the slide member.

According to a sixth aspect of the present invention, in the third aspect of the invention, the recording unit is characterized in that the engagement member is formed integrally with the ink jet heads.

According to a seventh aspect of the present invention, in the first aspect of the invention, the recording unit is characterized in that a supply pipe for supplying ink to the ink jet heads is connected to the other ends of the ink jet heads with respect to the sub scanning direction.

According to an eighth aspect of the present invention, there is provided an ink jet type recording apparatus characterized in that it is equipped with a recording unit according to the first aspect.

In the present invention as described above, it is possible to perform the positional adjustment of the ink jet head with respect to the carriage easily and with high accuracy.

DETAILED DESCRIPTION OF THE PREFERRED EMBODIMENTS

Embodiments of the present invention will now be described in detail.

Figure 1:
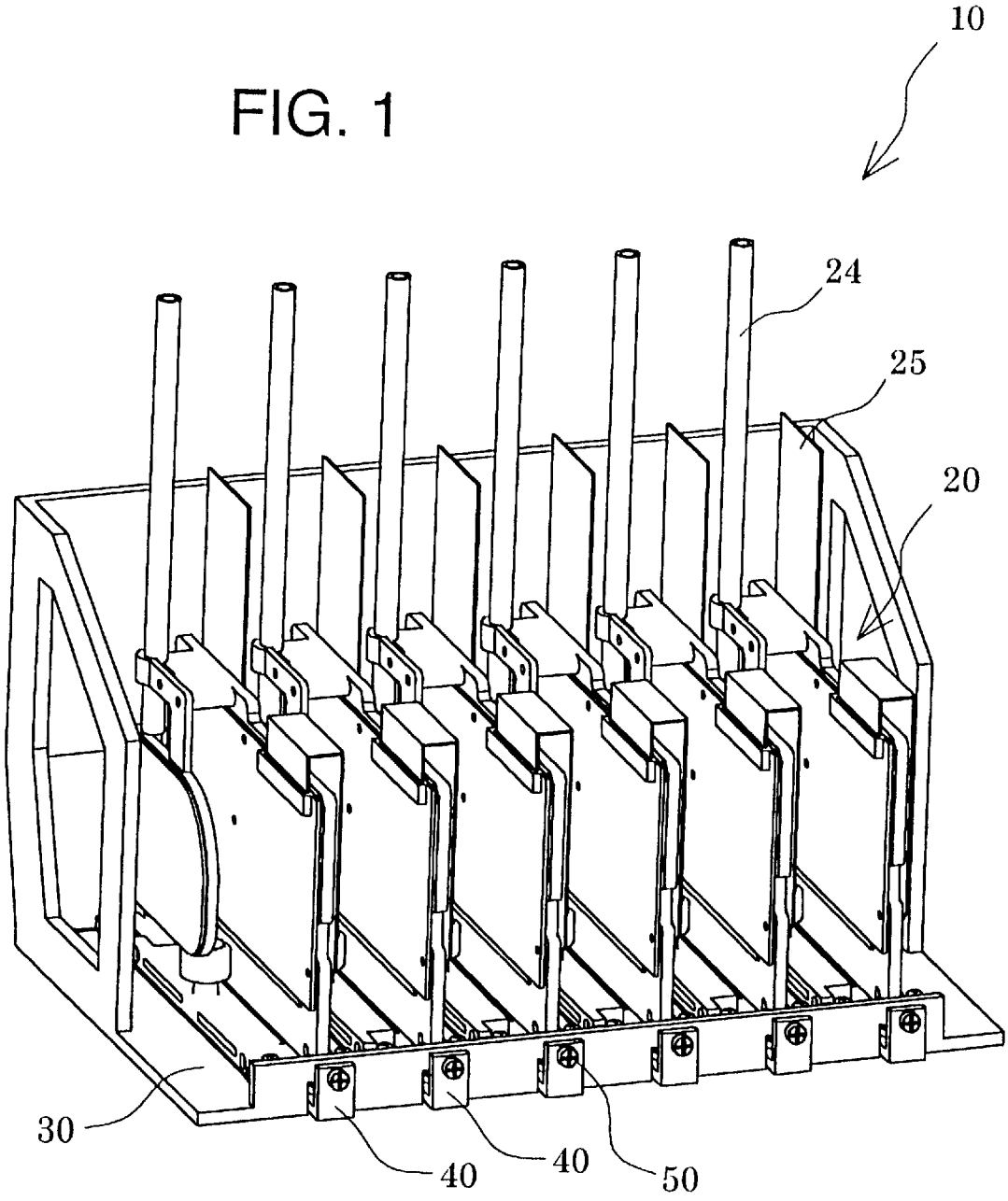
FIG. 1 is an assembly perspective view of a recording unit according to an embodiment of the present invention.
Figure 2A:
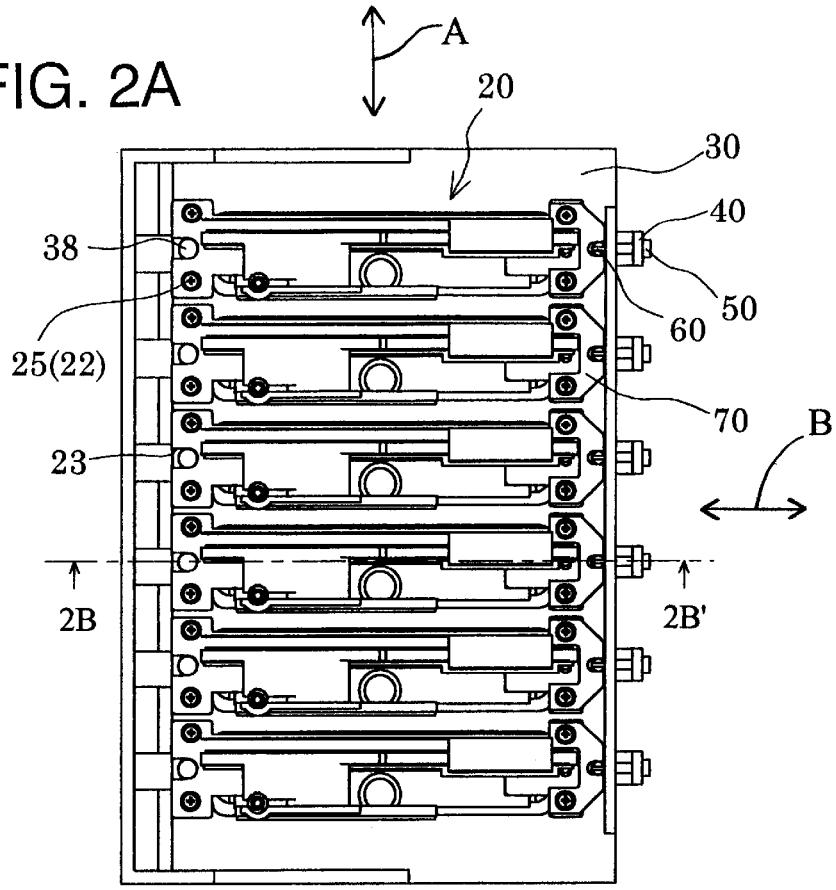
FIGS. 2A and 2B are a plan view and a sectional view along line 2B–2B' of a recording unit according to an embodiment of the present invention.
Figure 2B:
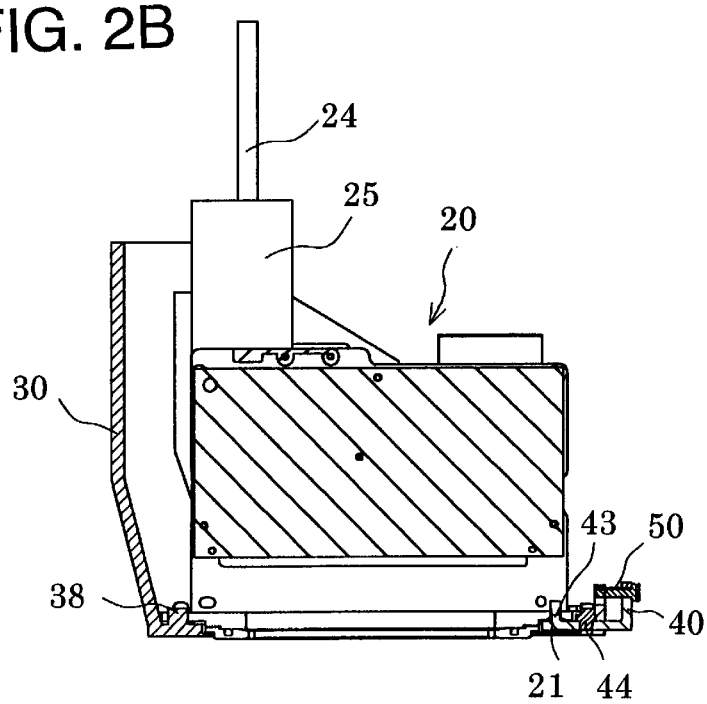
Figure 3:
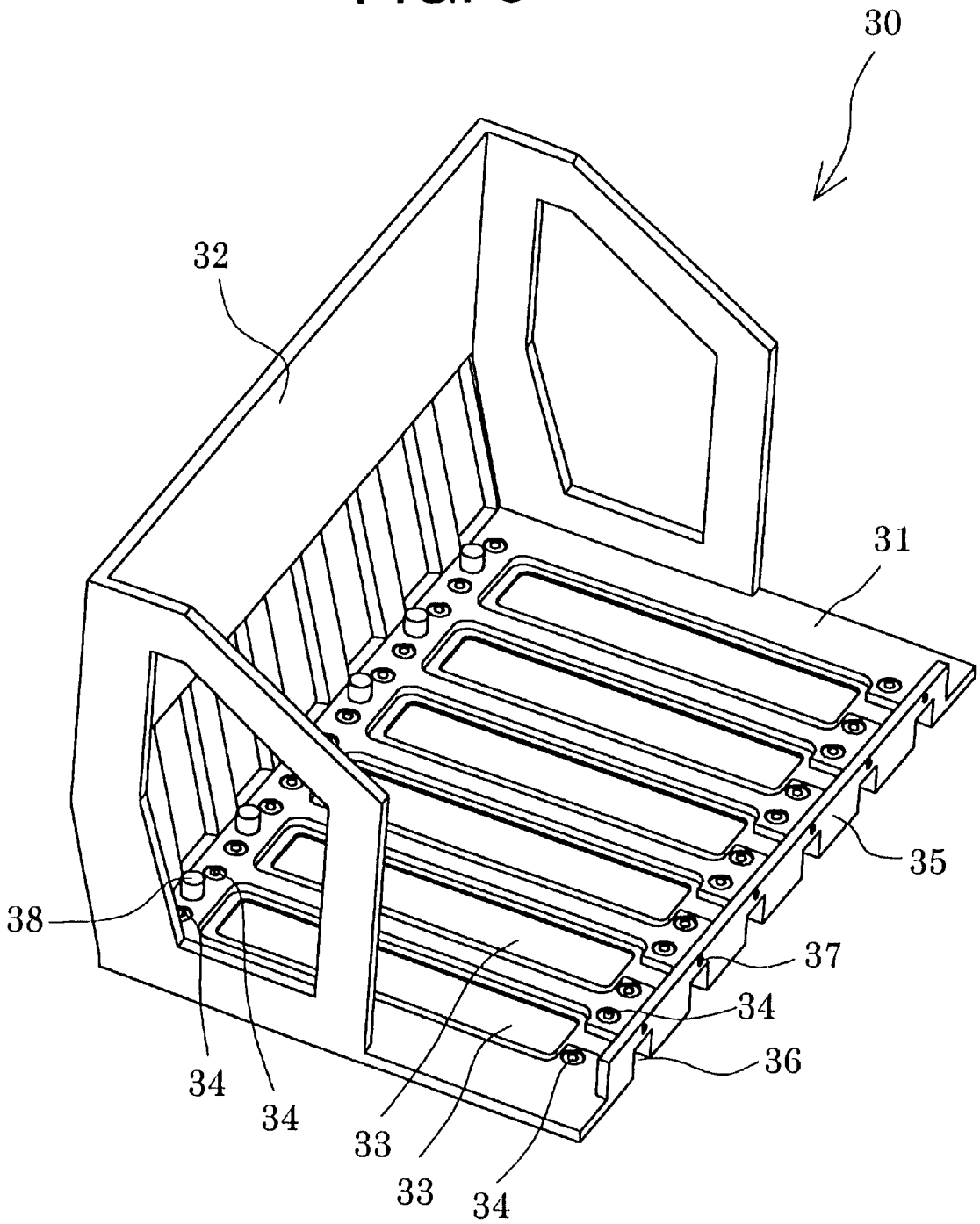
FIG. 3 is a perspective view of a carriage according to an embodiment of the present invention.
Figure 4A:
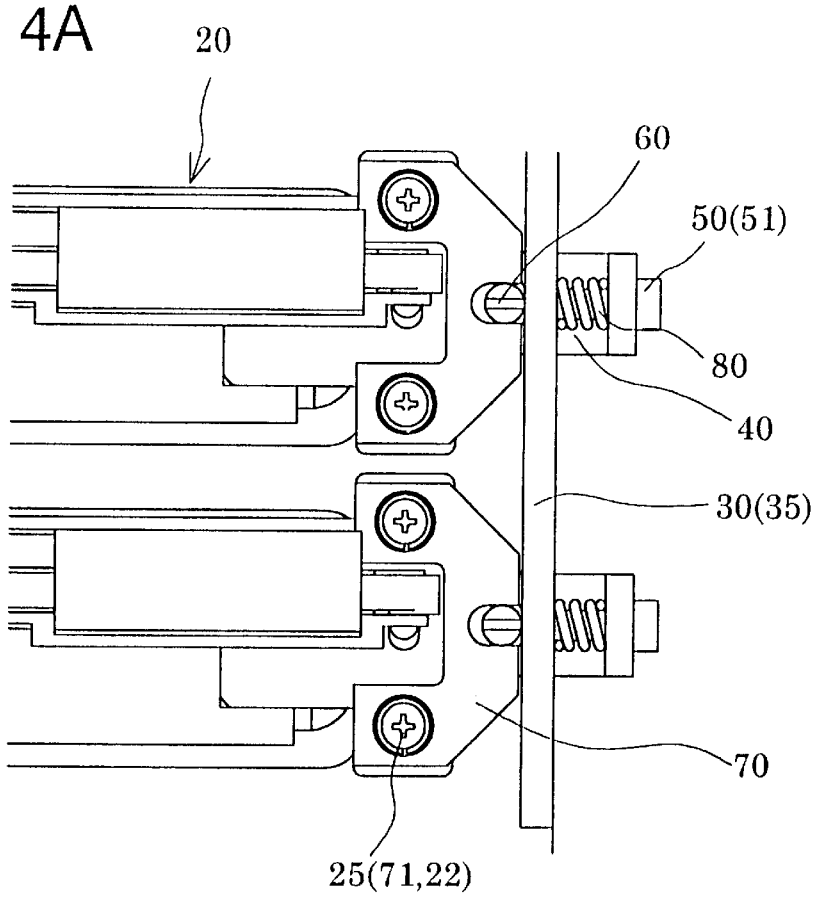
FIGS. 4A and 4B are enlarged views of a main portion of a recording unit according to an embodiment of the present invention.
Figure 5:
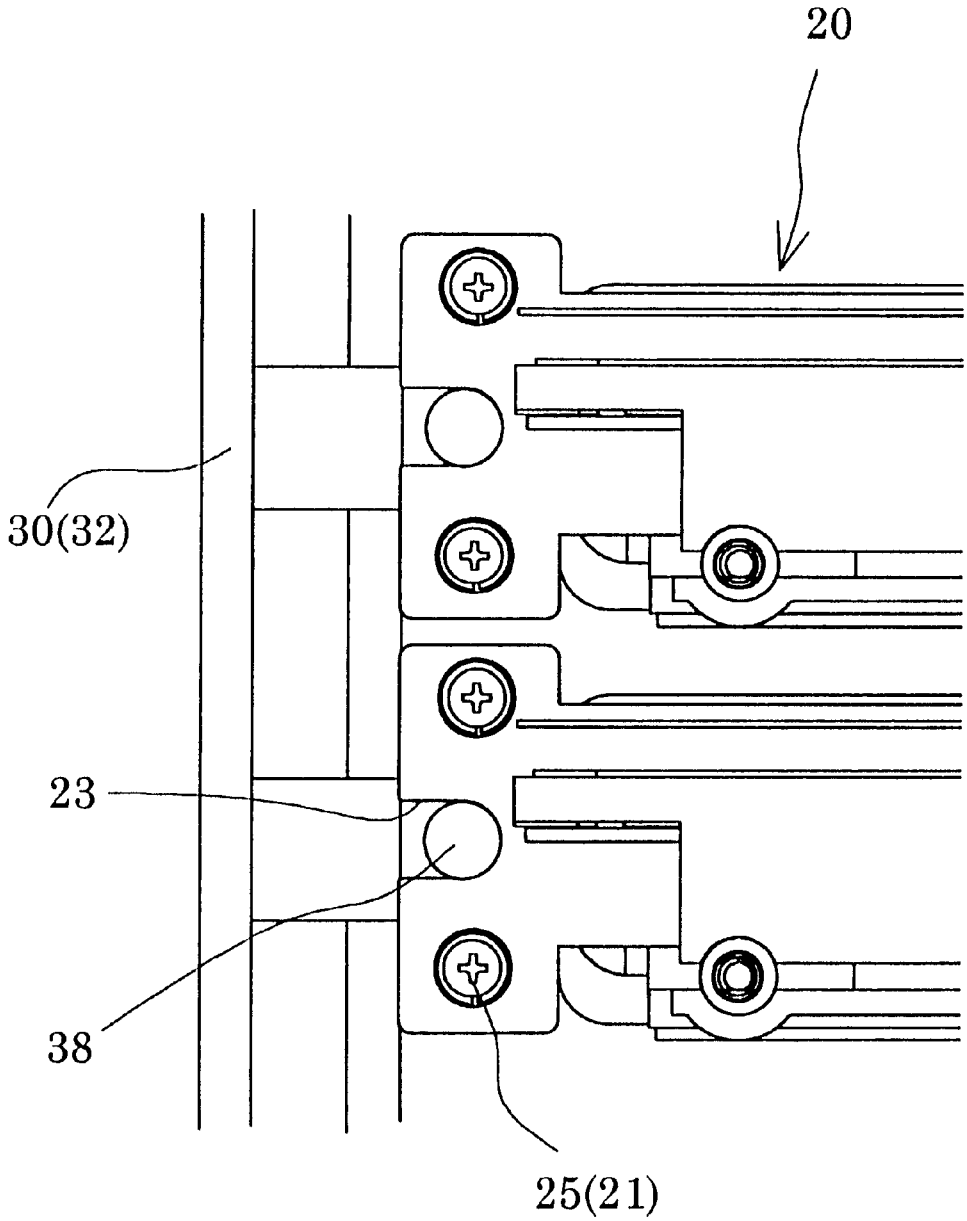
FIG. 5 is an enlarged view of a main portion of a recording unit according to an embodiment of the present invention.

FIG. 1 is an assembly perspective view of a recording unit according to an embodiment, FIGS. 2A and 2B include a plan view of the recording unit and a sectional view taken along the line 2B–2B', FIG. 3 is a perspective view of an carriage, FIGS. 4A ad 4B are enlarged views of a portion of an ink jet head near one longitudinal end thereof, and FIG. 5 is an enlarged view of a portion of the ink jet head near the other longitudinal end thereof.

As shown in FIGS. 1 and 2, a recording unit 10 according to this embodiment includes a plurality of ink jet heads 20 corresponding to inks of different colors, and a carriage 30 on which the plurality of ink jet heads 20 are mounted and is movable in a main scanning direction A extending generally perpendicular to a sub scanning direction B. Further, at one end with respect to the sub scanning direction perpendicular to the main scanning direction of the carriage 30, that is, at one longitudinal end of the ink jet heads 20 of the carriage 30, there are provided slide members 40 which allow positioning and movement in the sub scanning direction of the carriage 30 and which are positioned and fastened to the ink jet head 10.

As shown in FIG. 3, the carriage 30 is composed of a bottom plate 31 and a back plate 32. The bottom plate 31 is equipped with openings 33 through which the nozzle openings are exposed in correspondence with the respective ink jet heads 20. On the outer sides of the longitudinal ends thereof, there are formed female screw holes 34 to which are fastened screw members 25 for securing the ink jet heads 20 in position. Further, on the side of the bottom plate 31 opposite to the back plate 32, there is provided a fixing plate 35 for holding and fixing the slide members 40. Formed on the base end of the fixing plate 35 are insertion holes 36 through which the slide members 40 are inserted along the surface of the bottom plate 31. Above the insertion holes 36, there are formed female screw holes 37 to be threadedly engaged with screw members 50 which connect the slide members 40 to the carriage 30 and cause the slide members 40 to make a fine movement.

Further, on the outer, back-plate side of the openings of the bottom plate 31, there are provided protrusions 38 correspondence with the ink jet heads 20. On the protrusions 38, the ink jet heads 20 are supported so as to be restricted in movement in the main scanning direction only with respect to the carriage 30 and so as to be movable in the sub scanning direction and rotatable.

Figure 4B:
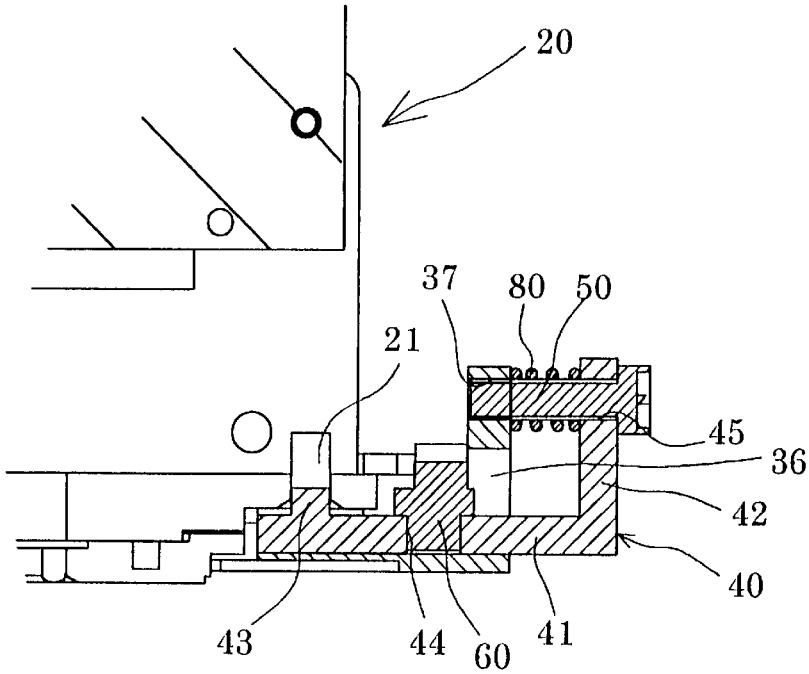
Figure 6:
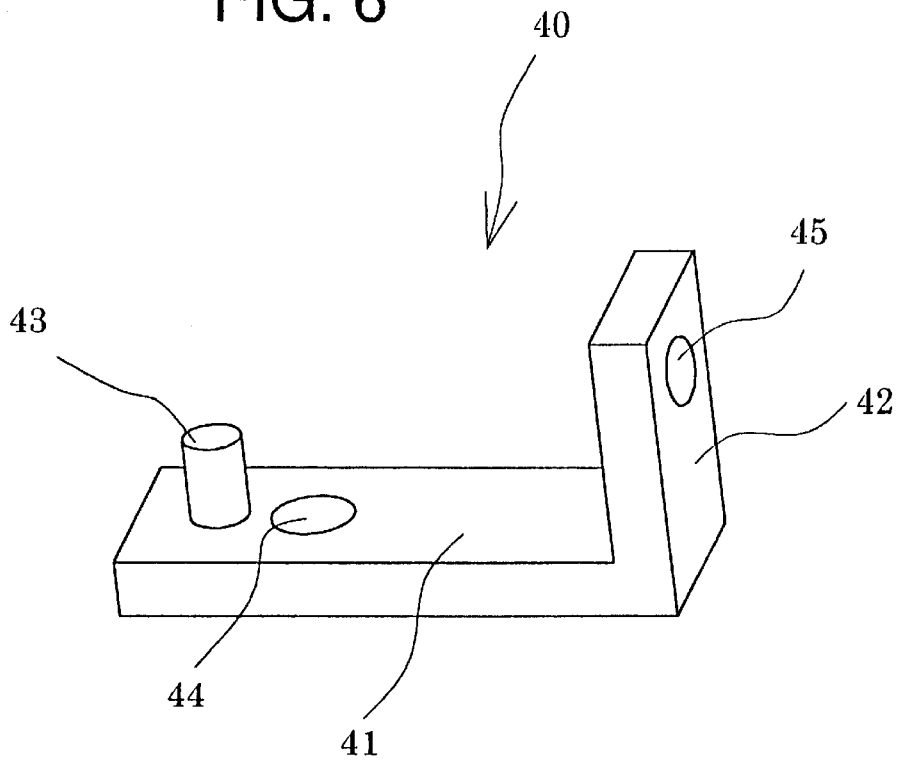
FIG. 6 is a perspective view of a slide member according to an embodiment of the present invention.

As shown in FIGS. 4 and 6, each slide member 40 comprises a slide portion 41 in sliding contact with the bottom plate 31 of the carriage 30, and a fixing portion 42 extending substantially vertically from one end of the slide portion 41 and opposed to the fixing plate 35 of the carriage 30 to exhibit a substantially L-shaped configuration. Further, near the end of the slide portion 41 opposite to the fixing portion 42, there is provided an engagement protrusion 43 to be engaged with an engagement hole 21 provided in the bottom portion of the ink jet head 20, and, at a position farther from the fixing portion 42 side than the engagement protrusion 43, there is formed a retaining hole 44 for rotatably retaining an eccentric pin 60. On the other hand, in the fixing portion 42, there is formed, at a position opposite to the female screw hole 37 of the carriage 30, a through-hole 45 through which the screw member 50 is passed.

The slide members 40 are arranged on the bottom plate 31 of the carriage 30 through the insertion holes 36, and the screw members 50 are passed through the through-holes 45 and threadedly engaged with the female screw holes 37 of the carriage 30, whereby the slide members are connected to the carriage 30. By rotating the screw members 50, the slide members 40 can move in the sub scanning direction. As will be described in detail below, by adjusting the amount by which the screw members 50 are threadedly engaged, the positional adjustment of the ink jet heads 20 effected. Thus, the slide members 40 must be constantly in contact with the heads 51 of the screw members 50. In view of this, in this embodiment, a spring member 80 is provided in the outer periphery of each screw member 50 between the carriage 30 and the slide member 40, thereby biasing the slide member 40 toward the head 51 side of the screw member 50 (See FIGS. 4A and 4B).

Each ink jet head 20 is an ink jet head having a plurality of nozzle openings arranged, for example, in a row, in a plurality of rows, or in a zigzag fashion, the ink jet heads being mounted on the carriage 30 so as to be arranged in the main scanning direction. Further, at the longitudinal ends of the ink jet heads 20, there are provided fixing holes 22 in correspondence with female screw holes 34 provided in the bottom plate 31 of the carriage 30. Screw members 25 are engaged with the female screw holes 34 through the fixing holes 22, thereby fixing the ink jet heads 20 to the carriage 30. Further, in the nozzle opening side surface of one longitudinal end portion of each ink jet head 20, there is formed an engagement hole 21 to be engaged with the engagement protrusion 43 of the slide member 40, and in the other longitudinal end portion, there is provided an engagement groove 23 to be engaged with a protrusion 38 of the carriage 30. It is desirable that the engagement hole 21 be an elongated hole whose diameter is relatively long in the scanning direction of the carriage 30. As will be described in detail below, this facilitates the positional adjustment of the ink jet heads 20 in the main scanning direction.

Figure 7:
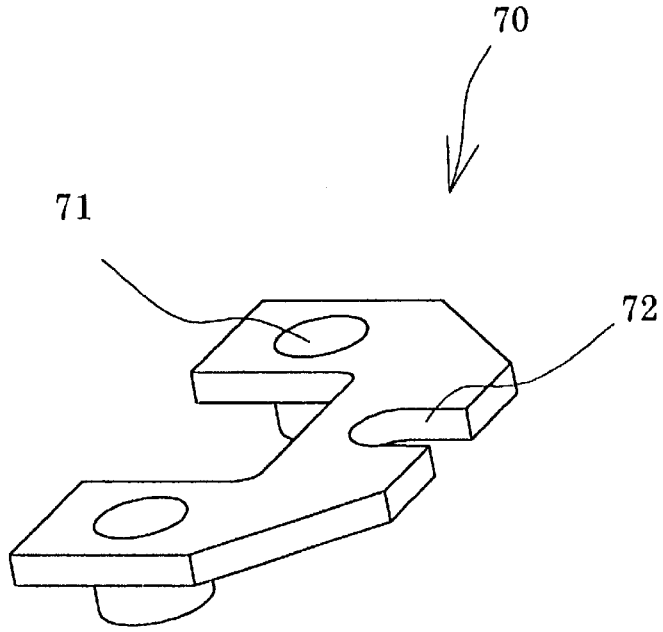
FIG. 7 is a perspective view of an engagement member according to an embodiment of the present invention.

Further, one longitudinal end portion of each ink jet head 20 is fixed to the carriage 30 by fastening the screw member 25 through an engagement member 70. As shown in FIG. 7, the engagement member 70 has a substantially U-shaped configuration so that it can hold one longitudinal end portion of the ink jet head 20 in the width direction, and includes communication holes 71 provided in correspondence with the fixing holes 22 of the ink jet head 20 and extending in the thickness direction, and an engagement groove 72 provided at the end of the region corresponding to the substantially central portion with respect to the width direction of the ink jet head 20 and adapted to engage with an eccentric pin 60 rotatably retained on the slide member 40. That is, by connecting the engagement member 70 and the slide member 40 by the rotatably retained eccentric pin 60, the ink jet head 20 is positioned and fixed with respect to the carriage 30, and by rotating the eccentric pin 60, rotation in the main scanning direction is possible using the protrusion 38 at the other end of the ink jet head 20. Thus, it is desirable that at least the width of the engagement groove 72 in the main scanning direction of the carriage 30 be substantially the same as the diameter of the eccentric pin 60. Due to this arrangement, it is possible to move the other end portion of the ink jet head 20 in the main scanning direction with high accuracy.

Further, the inner diameter of each fixing hole 22 of the ink jet head 20 and each communication hole 71 of the engagement member 71 is larger than the outer diameter of the screw member 25 by approximately several tens of $\mu$m. Thus, in the state in which the screw member 25 is temporarily fastened, the ink jet head 20 and the engagement member 70 are movable within the range of several tens of $\mu$m.

It is also possible for this engagement member 70 to be formed integrally with the ink jet head 20. That is, it is possible for the ink jet head 20 to have at one longitudinal end an engagement groove to be engaged with the eccentric pin 60. By thus forming the engagement member integrally with the ink jet head, the number of parts is reduced, and a reduction in cost can be achieved.

Figure 8A:
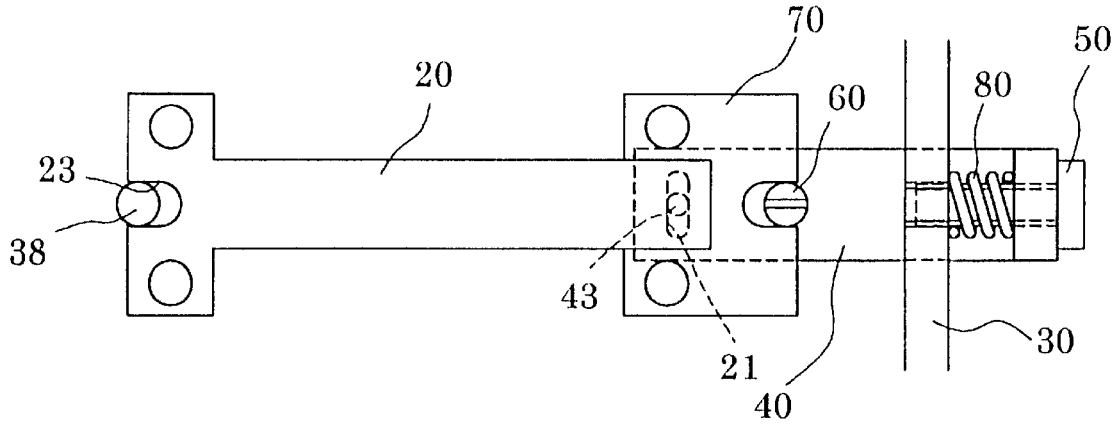
FIGS. 8A to 8C are schematic diagrams illustrating an ink jet head position adjusting operation.
Figure 8B:
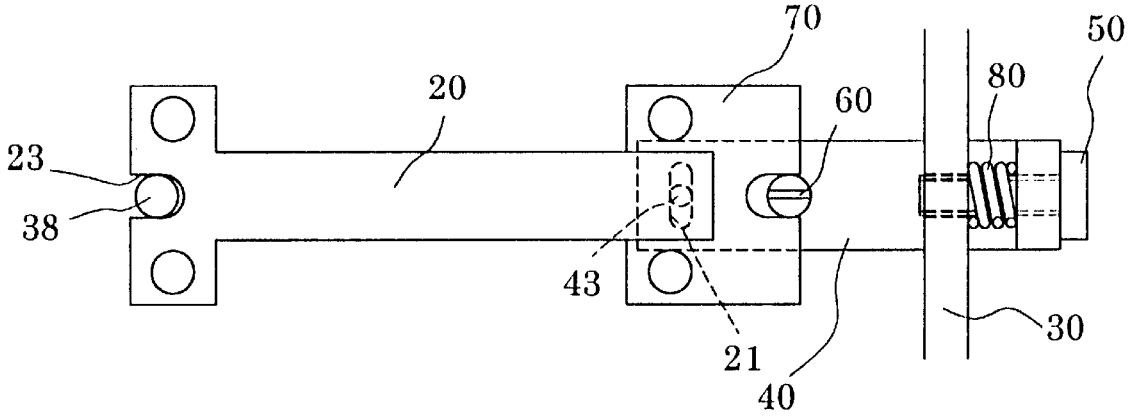
Figure 8C:
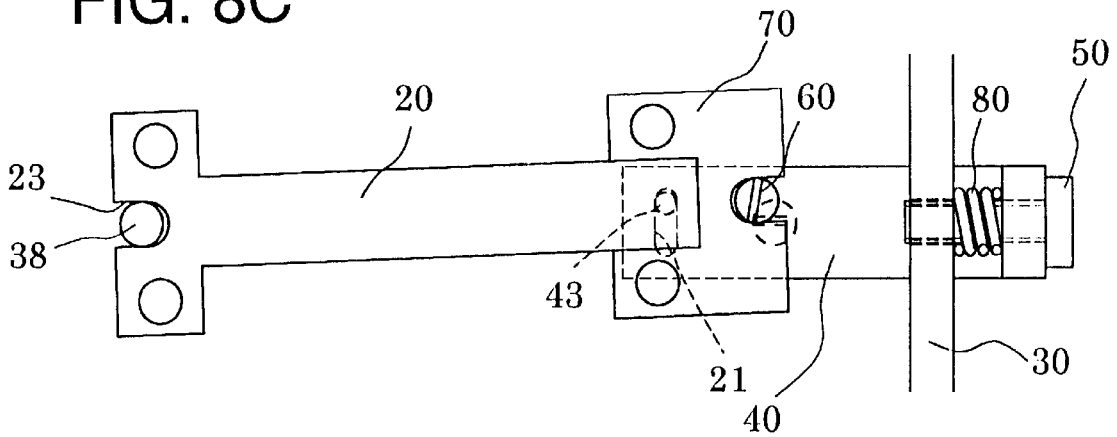

In the recording unit 10, constructed as described above, after mounting in the ink jet type recording apparatus, the positional adjustment of the ink jet heads 20 can be easily conducted by means of the slide members 40, etc. In the following, a method of adjusting the positions of the ink jet heads 20 of the recording unit 10 of this embodiment will be described. FIG. 8A to FIG. 8C are schematic diagrams illustrating the movement involved in the positional adjustment of the ink jet head.

First, an ink jet head serving as a reference is installed at one end of the carriage 30 with respect to the scanning direction so as to be positioned substantially at the center of the opening 33. That is, the ink jet head is fastened to the carriage such that the adjustment amount of the slide member 40 is approximately the same both ways in the sub scanning direction and that the adjustment amount of the eccentric pin 60 is approximately the same both ways in the main scanning direction. And, using this ink jet head as a reference, positional adjustment is performed on the other ink jet heads.

The positional adjustment of each ink jet head 20 is performed as follows. First, as shown in FIG. 8A, the printing of a predetermined pattern is conducted, with the ink jet head 20 being temporarily fixed at a predetermined position of the carriage 30 by the screw member 25. And, from this print pattern, deviation amounts with respect to the reference ink jet head are measured. Here, the deviation amounts include the angular deviation with respect to the sub scanning direction of the carriage 30 and the positional deviation amount in the sub scanning direction between each ink jet head 20 and the reference ink jet head.

Next, each ink jet head 20 is moved in accordance with the deviation amounts measured. Specifically, first, the positional deviation of the ink jet head 20 in the sub scanning direction is adjusted. That is, as shown in FIG. 8B, the slide member 40 corresponding to the ink jet head 20 whose positional deviation has been detected is caused to slide in the sub scanning direction, whereby the ink jet head 20 is moved to a predetermined position in the sub scanning direction together with the slide member 40.

Here, in this embodiment, the slide member 40 is connected by means of the screw member 50 threadedly engaged with the female screw hole 37 of the carriage 30, 50 that by adjusting the amount by which this screw member 50 is threadedly engaged with the female screw hole 37, it is possible to cause the slide member 40 to make a fine movement in the sub scanning direction of the carriage 30. That is, it is possible to cause the ink jet head 20 to make a fine movement in the sub scanning direction. Further, as described above, the end portion of the ink jet head 20 on the opposite side of the slide member 40 is supported by the protrusion 38 so as to be movable in the sub scanning direction, so that the ink jet head 20 makes a fine movement in the sub scanning direction together with the slide member 40.

When the movement amount of the ink jet head 20 with respect to the rotation amount of the screw member 50 is measured beforehand, it is possible to control the movement amount of the ink jet head 20 relatively accurately and easily based on the engagement amount of the screw member 50.

Next, the angular deviation of the ink jet head 20 with respect to the sub scanning direction is adjusted. Specifically, as shown in FIG. 8C, by rotating the eccentric pin 60 by a predetermined amount, one longitudinal end portion of the ink jet head 20 is moved in the main scanning direction of the carriage 30 through the intermediation of the engagement member 70 engaged with the eccentric pin 60. Here, the other end portion of the ink jet head 20 with respect to the sub scanning direction is restricted in its movement in the scanning direction and rotatably supported by the protrusion 38 of the carriage 30. Thus, the ink jet head 20 is rotated by a predetermined amount in the main scanning direction of the carriage 30, using this protrusion 38 as a reference. That is, by rotating the eccentric pin 60, the angular deviation of the ink jet head 20 with respect to the sub scanning direction can be easily adjusted. As described above, the engagement hole 21 of the ink jet head 20 engaged with the protrusion 43 of the slide member 40 is formed as an elongated hole, so that the ink jet head 20 is reliably moved in the sub scanning direction, without abutting the slide member 40.

Thereafter, by fastening each screw member 25, the ink jet heads 20 are positioned and fixed at predetermined positions of the carriage. At the same time, the slide members 40 are positioned and fixed at predetermined positions by the ink jet heads 20.

In this way, in this embodiment, by moving the slide member 40 engaged with one longitudinal end portion of the ink jet head 20, the positional adjustment of the ink jet head 20 in the sub scanning direction can be easily conducted. Further, by rotating the eccentric pin 60, the ink jet head 20 is moved in the main scanning direction of the carriage 30 through the intermediation of the engagement member 70, whereby the angular deviation of the ink jet head 20 with respect to the sub scanning direction can be easily adjusted.

Further, at the other longitudinal end of each ink jet head 20 of this embodiment, there are provided a supply pipe 24 for supplying ink to the ink jet head 20, wiring 25 for transmitting a drive signal to the piezoelectric element of the ink jet head 20, etc. (See FIG. 1). By contrast, the slide member 40 for performing the positional adjustment in the sub scanning direction of the ink jet head 20, the eccentric pin 60 for adjusting the angular deviation with respect to the sub scanning direction, and the engagement member 70 are provided at one longitudinal end of the ink jet head 20, that is, on the side opposite to the back plate 32 of the carriage 30, so that the position adjusting operation can be conducted relatively easily. Further, it is possible to perform all the position adjusting operations for the ink jet head 20 at one position, so that an improvement can be achieved in terms of operational efficiency. Of course, when the requisite operating space can be ensured, it is also possible to provide the slide member 40, the eccentric pin 60, and the engagement member 70 at the other longitudinal end of the ink jet head 20. Further, it is also possible to provide them at both longitudinal ends.

Further, while in this embodiment the slide member 40 is provided with the engagement protrusion 43, and the ink jet head 20 is provided with the engagement hole 21, and they are engaged with each other, this should not be construed restrictively. It is naturally also possible to provide the slide member 40 with an engagement hole, and to provide the ink jet head 20 with an engagement protrusion.

Figure 9:
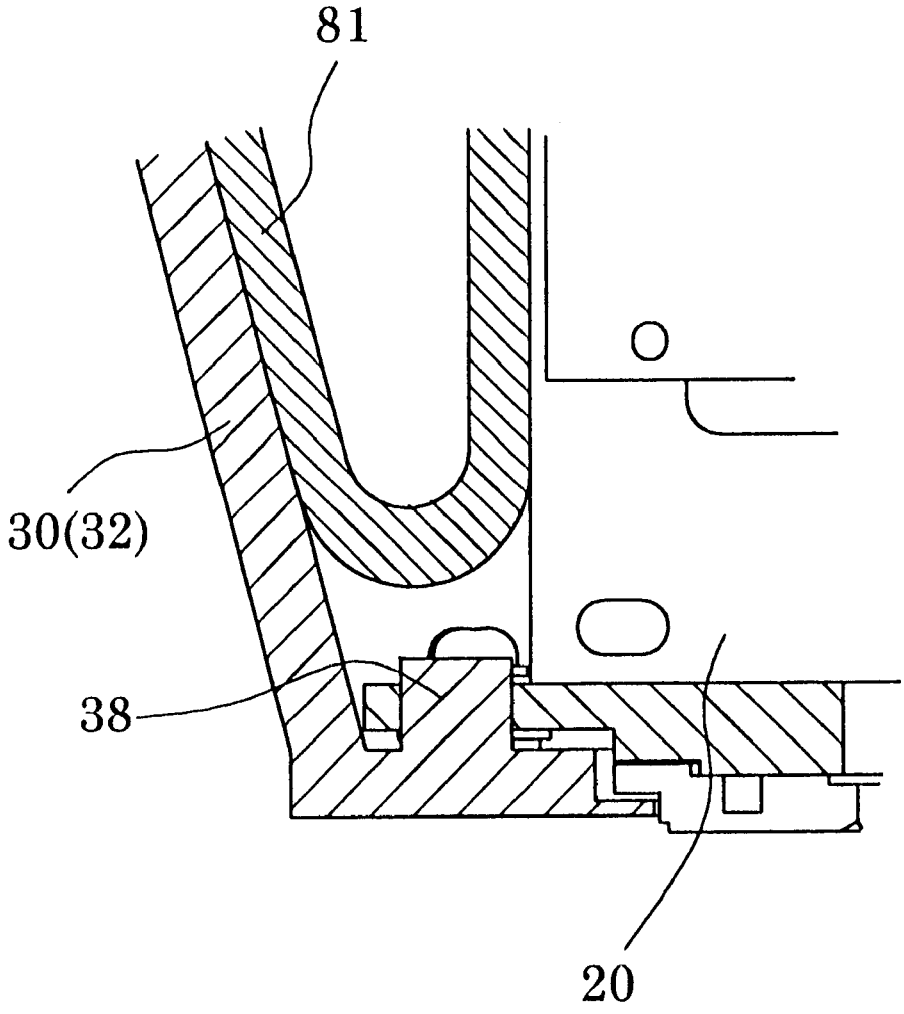
FIG. 9 is a sectional view of a main portion of another example of a recording unit according to an embodiment of the present invention.

Further, while in the above-described embodiment the spring member 80 is provided in the outer periphery of the screw member 50 between the carriage 30 and the slide member 40, this should not be construed restrictively. For example, as shown in FIG. 9, it is also possible to provide a plate spring member 81 between the back plate 32 of the carriage 30 and the ink jet head 20 to thereby bias the slide member 40.

The present invention is not restricted to the construction of the embodiment described above.

As described above, in accordance with the present invention, by causing the slide member to slide, the positional adjustment of the ink jet head in the sub scanning direction can be effected easily and with high accuracy. Further, by rotating the eccentric pin, the angle of the ink jet head with respect to the sub scanning direction can be adjusted through the engagement member easily and with high accuracy. Thus, the requisite time for the positional adjustment of the ink jet head is shortened, and a reduction in cost can be achieved.

What is claimed is:

1. A recording unit comprising: a carriage for undergoing movement in a main scanning direction; a plurality of slide members mounted on the carriage for undergoing sliding movement relative to the carriage in a sub-scanning direction extending generally perpendicular to the main scanning direction; and a plurality of ink jet heads mounted on the carriage and having a plurality of nozzle openings for ejecting ink, a first end portion mounted on the carriage for undergoing rotation relative to the carriage and for undergoing movement relative to the carriage in the sub-scanning direction but restricted from undergoing movement relative to the carriage in the main scanning direction, and a second end portion connected to a respective one of the slide members for undergoing sliding movement relative to the carriage in the sub-scanning direction.

2. A recording unit according to claim 1; further comprising a plurality of screw members each for connecting a respective one of the slide members to the carriage by threaded engagement with a female screw hole passing through the slide member and the carriage, the screw member having a length sufficient for engaging both the slide member and the carriage so that the slide member can be positioned and moved in the sub-scanning direction by adjusting an amount by which the screw member is engaged with the female screw hole.

3. A recording unit according to claim 1; wherein each of the ink jet heads has an engagement member at the second end portion thereof; and further comprising a plurality of rotatable eccentric pins each for connecting the engagement member of a respective one of the ink jet heads with the carriage to position the ink jet head with respect to the carriage so that upon rotation of the eccentric pin, the second end portion of the ink jet head is moved in the main scanning direction.

4. A recording unit according to claim 2; further comprising a plurality of biasing members each for biasing a respective one of the ink jet heads in the sub-scanning direction to place the ink jet head at a position in the sub-scanning direction corresponding to the amount by which the screw member is threadedly engaged with the female screw hole.

5. A recording unit according to claim 4; wherein each of the biasing members comprises a spring member disposed between the carriage and a respective one of the slide members and around an outer periphery of a respective one of the screw members.

6. A recording unit according to claim 3; wherein each of the engagement members is formed in one piece with a respective one of the ink jet heads.

7. A recording unit according to claim 1; further comprising a plurality of supply pipes each connected to the first end portion of a respective one of the ink jet heads for supplying ink to the ink jet heads.

8. An ink jet type recording apparatus having a recording unit as claimed in claim 1.

9. A recording unit comprising: a carriage mounted to undergo movement in a main scanning direction; a plurality of ink jet heads mounted on the carriage for undergoing rotation independently from one another relative to the carriage and for undergoing movement independently from one another relative to the carriage in a sub-scanning direction extending generally perpendicular to the main scanning direction; first adjusting means for independently adjusting a position of each of the ink jet heads relative to the carriage in the sub-scanning direction; and second adjusting means for independently adjusting an angular deviation of each of the ink jet heads with respect to the sub-scanning direction; wherein each of the ink jet heads has a first end portion mounted on the carriage for undergoing rotation relative to the carriage and undergoing movement relative to the carriage in the sub-scanning direction but restricted from undergoing movement relative to the carriage in the main scanning direction, and a second end portion; and wherein the first adjusting means comprises a plurality of slide members mounted on the carriage for undergoing sliding movement relative to the carriage in a sub-scanning direction, each of the slide members being connected to the second end portion of a respective one of the ink jet heads, and a plurality of screw members each for connecting a respective one of the slide members to the carriage by threaded engagement with a female screw hole passing through the slide member so that the slide member can be positioned and moved in the sub-scanning direction by adjusting an amount by which the screw member is engaged with the female screw hole.

10. A recording unit according to claim 9; wherein the first adjusting means further comprises a plurality of biasing members each for biasing a respective one of the ink jet heads in the sub-scanning direction to place the ink jet head at a position in the sub-scanning direction corresponding to the amount by which the screw member is threadedly engaged with the female screw hole.

11. A recording unit according to claim 10; wherein each of the biasing members comprises a spring member disposed between the carriage and a respective one of the slide members and around an outer periphery of a respective one of the screw members.

12. A recording unit according to claim 11; wherein the second adjusting means comprises a plurality of rotatable eccentric pins each for connecting the second end portion of a respective one of the ink jet heads with the carriage to position the ink jet head with respect to the carriage so that upon rotation of the eccentric pin, the second end portion of the ink jet head is moved in the main scanning direction to thereby adjust an angular deviation of the ink jet head with respect to the sub-scanning direction.

13. A recording unit comprising: a carriage mounted to undergo movement in a main scanning direction; a slide member mounted on the carriage for undergoing sliding movement relative to the carriage in a sub-scanning direction extending generally perpendicular to the main scanning direction; at least one ink jet head mounted on the carriage and having a first end portion mounted on the carriage for undergoing rotation relative to the carriage and for undergoing movement relative to the carriage in the sub-scanning direction but restricted from undergoing movement relative to the carriage in the main scanning direction, and a second end portion connected to the slide member for undergoing sliding movement relative to the carriage in the sub-scanning direction; and a rotatable eccentric pin for connecting the second end portion of the ink jet head with the carriage to position the ink jet head with respect to the carriage so that upon rotation of the eccentric pin, the second end portion of the ink jet head is moved in the main scanning direction.

14. An ink jet type recording apparatus having a recording unit as claimed in claim 13.

15. A recording unit comprising: a carriage mounted to undergo movement in a main scanning direction; a slide member mounted on the carriage for undergoing sliding movement relative to the carriage in a sub-scanning direction extending generally perpendicular to the main scanning direction; at least one ink jet head mounted on the carriage and having a first end portion mounted on the carriage for undergoing rotation relative to the carriage and for undergoing movement relative to the carriage in the sub-scanning direction but restricted from undergoing movement relative to the carriage in the main scanning direction, and a second end portion connected to the slide member for undergoing sliding movement relative to the carriage in the sub-scanning direction; a screw member for connecting the slide member to the carriage by threaded engagement with a female screw hole passing through the slide member so that the slide member can be positioned and moved in the sub-scanning direction by adjusting an amount by which the screw member is engaged with the female screw hole; and a biasing member disposed between the carriage and the slide member and around an outer periphery of the screw member for biasing the ink jet head in the sub-scanning direction to place the ink jet head at a position in the sub-scanning direction corresponding to the amount by which the screw member is threadedly engaged with the female screw hole.

16. A recording unit according to claim 15; wherein the biasing member comprises a spring member.

17. A recording unit according to claim 15; further comprising a rotatable eccentric pin for connecting the second end portion of the ink jet head with the carriage to position the ink jet head with respect to the carriage so that upon rotation of the eccentric pin, the second end portion of the ink jet head is moved in the main scanning direction.

18. An ink jet type recording apparatus having a recording unit as claimed in claim 15.

* * * * *